US006582323B2

(12) United States Patent
Soracco et al.

(10) Patent No.: US 6,582,323 B2
(45) **Date of Patent: *Jun. 24, 2003**

(54) MULTIPLE MATERIAL GOLF CLUB HEAD

(75) Inventors: Peter L. Soracco, Carlsbad, CA (US); Richard C. Helmstetter, Rancho Santa Fe, CA (US); Alan Hocknell, Encinitas, CA (US); Matthew T. Cackett, San Diego, CA (US); Herbert Reyes, Laguna Niguel, CA (US); James M. Murphy, Oceanside, CA (US); J. Andrew Galloway, Escondido, CA (US); Augustin W. Rollinson, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/683,860

(22) Filed: Feb. 22, 2002

(65) Prior Publication Data

US 2002/0193175 A1 Dec. 19, 2002

Related U.S. Application Data

(63) Continuation-in-part of application No. 09/906,889, filed on Jul. 16, 2001, now Pat. No. 6,491,592, which is a continuation-in-part of application No. 09/431,982, filed on Nov. 1, 1999, now Pat. No. 6,354,962.

(51) Int. Cl.[7] ..... A63B 53/04

(52) U.S. Cl. ..... 473/342; 473/329; 473/345; 473/349

(58) Field of Search ..... 473/324, 329, 473/330, 334, 335, 342, 345, 349, 350

(56) References Cited

U.S. PATENT DOCUMENTS

| | | | |
|---|---|---|---|
| 1,167,387 | A | 1/1916 | Daniel |
| 1,638,916 | A | 8/1927 | Butchart |
| 1,780,625 | A | 11/1930 | Mattern |

(List continued on next page.)

OTHER PUBLICATIONS

Golf Digest, Dec. 1978.
Golf Digest, Jun. 1981.

*Primary Examiner*—Paul T. Sewell
*Assistant Examiner*—Tom P Duong
(74) *Attorney, Agent, or Firm*—Michael A. Catania

(57) ABSTRACT

A golf club (40) having a club head (42) with a face component (60) and an aft body (61) is disclosed herein. The face component (60) has a striking plate portion (72) and a return portion (74). The aft-body (61) is composed of a crown portion (62), a sole portion (64) and optionally a ribbon section (90). The face component (60) is composed of a metal material, and the aft-body (61) is composed of a non-metal material such as a composite material or a thermoplastic material. The striking plate portion (72) preferably has an aspect ratio less than 1.7. The striking plate portion (72) preferably has concentric regions of thickness with the thickness portion in the center (102). The club head (42) has a volume in the range of 290 cubic centimeters to 600 cubic centimeters, a weight in the range of 165 grams to 300 grams, and a striking plate portion (72) surface area in the range of 4.00 square inches to 7.50 square inches. The golf club head (42) has a coefficient of restitution greater than 0.81 under test conditions such as the USGA test conditions specified pursuant to Rule 4-1e, Appendix II, of the Rules of Golf for 1998–1999.

18 Claims, 13 Drawing Sheets

U.S. PATENT DOCUMENTS

| | | | | |
|---|---|---|---|---|
| 2,750,194 | A | | 6/1956 | Clark |
| 3,692,306 | A | | 9/1972 | Glover |
| 3,897,066 | A | | 7/1975 | Belmont |
| 3,937,474 | A | | 2/1976 | Jepson et al. |
| 3,970,236 | A | | 7/1976 | Rogers |
| 3,975,023 | A | | 8/1976 | Inamori |
| 3,989,248 | A | | 11/1976 | Campau |
| 4,021,047 | A | | 5/1977 | Mader |
| 4,398,965 | A | | 8/1983 | Campau |
| 4,568,088 | A | | 2/1986 | Kurahashi |
| 4,872,685 | A | | 10/1989 | Sun |
| 4,877,249 | A | | 10/1989 | Thompson |
| 5,024,437 | A | | 6/1991 | Anderson |
| 5,094,383 | A | | 3/1992 | Anderson |
| 5,106,094 | A | | 4/1992 | Desbiolles et al. |
| 5,193,811 | A | | 3/1993 | Okumoto et al. |
| 5,255,918 | A | | 10/1993 | Anderson |
| 5,261,663 | A | | 11/1993 | Anderson |
| 5,261,664 | A | | 11/1993 | Anderson |
| 5,282,624 | A | | 2/1994 | Viste |
| 5,310,185 | A | | 5/1994 | Viollez et al. |
| 5,344,340 | A | | 9/1994 | Bouleau |
| 5,346,216 | A | | 9/1994 | Aizawa |
| 5,377,986 | A | | 1/1995 | Viollaz et al. |
| 5,398,935 | A | | 3/1995 | Katayamo |
| 5,410,798 | A | | 5/1995 | Lo |
| 5,425,538 | A | | 6/1995 | Vincent et al. |
| 5,464,210 | A | | 11/1995 | Davis et al. |
| 5,474,296 | A | | 12/1995 | Schmidt et al. |
| 5,499,814 | A | | 3/1996 | Lu |
| 5,516,107 | A | | 5/1996 | Okumoto et al. |
| 5,547,427 | A | | 8/1996 | Rigal et al. |
| 5,570,886 | A | | 11/1996 | Rigal et al. |
| 5,624,331 | A | | 4/1997 | Lo et al. |
| 5,743,813 | A | | 4/1998 | Chen et al. |
| 5,776,011 | A | | 7/1998 | Su et al. |
| 5,830,084 | A | | 11/1998 | Kosmatka |
| 5,863,261 | A | | 1/1999 | Eggiman |
| 5,888,148 | A | | 3/1999 | Allen |
| 6,048,278 | A | | 4/2000 | Meyer et al. |
| 6,146,571 | A | | 11/2000 | Vincent et al. |
| 6,149,534 | A | | 11/2000 | Peters et al. |
| 6,152,833 | A | | 11/2000 | Werner et al. |
| 6,165,081 | A | | 12/2000 | Chou |
| 6,310,185 | B1 | | 10/2001 | Wallace et al. |
| 6,354,962 | B1 | * | 3/2002 | Galloway et al. ..... 473/342 |
| 6,386,990 | B1 | * | 5/2002 | Reyes et al. ..... 473/344 |
| 6,398,666 | B1 | * | 6/2002 | Evans et al. ..... 473/345 |
| 6,440,011 | B1 | * | 8/2002 | Hocknell et al. ..... 473/342 |
| 6,491,592 | B2 | * | 12/2002 | Cackett et al. ..... 473/342 |
| 2002/0187853 | A1 | | 12/2002 | Beach et al. |

* cited by examiner 60
74
82
78
76
80
54
118
120
59
61
70
90
64
91
93
95
62
62a
64a
122
122b
122c
122a
42
46
75
72
190
170
195
$L_G$
$L_O$
175
180

MULTIPLE MATERIAL GOLF CLUB HEAD

CROSS REFERENCES TO RELATED APPLICATIONS

This application is a continuation-in-part application of U.S. patent application Ser. No. 09/906,889, filed on. Jul. 16, 2001, now U.S. Pat. No. 6,491,592, which is a continuation-in-past of U.S. patent application Ser. No. 09/431,982, filed Nov. 1, 1999, now U.S. Pat. No. 6,354,962.

FEDERAL RESEARCH STATEMENT

[Not Applicable]

BACKGROUND OF INVENTION

1. Field of the Invention

The present invention relates to a golf club head with a face component composed of a metal material, and an aft-body composed of a light-weight material. More specifically, the present invention relates to a golf club head with face component composed of a metal material for a more efficient transfer of energy to a golf ball at impact, and a non-metallic aft-body to control the mass distribution.

2. Description of the Related Art

When a golf club head strikes a golf ball, large impacts are produced that load the club head face and the golf ball. Most of the energy is transferred from the head to the golf ball, however, some energy is lost as a result of the collision. The golf ball is typically composed of polymer cover materials (such as ionomers) surrounding a rubber-like core. These softer polymer materials having damping (loss) properties that are strain and strain rate dependent which are on the order of 10–100 times larger than the damping properties of a metallic club face. Thus, during impact most of the energy is lost as a result of the high stresses and deformations of the golf ball (0.001 to 0.20 inch), as opposed to the small deformations of the metallic club face (0.025 to 0.050 inch). A more efficient energy transfer from the club head to the golf ball could lead to greater flight distances of the golf ball.

The generally accepted approach has been to increase the stiffness of the club head face to reduce metal or club head deformations. However, this leads to greater deformations in the golf ball, and thus increases in the energy transfer problem.

Some have recognized the problem and disclosed possible solutions. An example is Campau, U.S. Pat. No. 4,398,965, for a Method Of Making Iron Golf Clubs With Flexible Impact Surface, which discloses a club having a flexible and resilient face plate with a slot to allow for the flexing of the face plate. The face plate of Campau is composed of a ferrous material, such as stainless steel, and has a thickness in the range of 0.1 inches to 0.125 inches. Another example is Eggiman, U.S. Pat. No. 5,863,261, for a Golf Club Head With Elastically Deforming Face And Back Plates, which discloses the use of a plurality of plates that act in concert to create a spring-like effect on a golf ball during impact. A fluid is disposed between at least two of the plates to act as a viscous coupler.

Yet another example is Jepson et al, U.S. Pat. No. 3,937,474, for a golf Club With A Polyurethane Insert. Jepson discloses that the polyurethane insert has a hardness between 40 and 75 shore D.

Still another example is Inamori, U.S. Pat. No. 3,975,023, for a Golf Club Head With Ceramic Face Plate, which discloses using a face plate composed of a ceramic material having a high energy transfer coefficient, although ceramics are usually harder materials. Chen et al., U.S. Pat. No. 5,743,813 for a Golf Club Head, discloses using multiple layers in the face to absorb the shock of the golf ball. One of the materials is a non-metal material.

Lu, U.S. Pat. No. 5,499,814, for a Hollow Club Head With Deflecting Insert Face Plate, discloses a reinforcing element composed of a plastic or aluminum alloy that allows for minor deflecting of the face plate which has a thickness ranging from 0.01 to 0.30 inches for a variety of materials including stainless steel, titanium, KEVLAR®, and the like. Yet another Campau invention, U.S. Pat. No. 3,989,248, for a Golf Club Having Insert Capable Of Elastic Flexing, discloses a wood club composed of wood with a metal insert.

Although not intended for flexing of the face plate, Viste, U.S. Pat. No. 5,282,624 discloses a golf club head having a face plate composed of a forged stainless steel material and having a thickness of 3 mm. Anderson, U.S. Pat. No. 5,344,140, for a Golf Club Head And Method Of Forming Same, also discloses use of a forged material for the face plate. The face plate of Anderson may be composed of several forged materials including steel, copper and titanium. The forged plate has a uniform thickness of between 0.090 and 0.130 inches.

Another invention directed toward forged materials in a club head is Su et al., U.S. Pat. No. 5,776,011 for a Golf Club Head. Su discloses a club head composed of three pieces with each piece composed of a forged material. The main objective of Su is to produce a club head with greater loft angle accuracy and reduce structural weaknesses. Aizawa, U.S. Pat. No. 5,346,216 for a Golf Club Head, discloses a face plate having a curved ball hitting surface.

U.S. Pat. No. 6,146,571 to Vincent, et al., discloses a method of manufacturing a golf club head wherein the walls are obtained by injecting a material such as plastic over an insert affixed to a meltable core. The core has a melt point lower than that of the injectable plastic material so that once the core is removed, an inner volume is maintained to form the inner cavity. The insert may comprise a resistance element for reinforcing the internal portion of the front wall of the shell upon removal of the core where the reinforcement element is comprised of aluminum with a laterally extending portion comprised of steel.

U.S. Pat. No. 6,149,534 to Peters, et al., discloses a golf club head having upper and lower metal engagement surfaces formed along a single plane interface wherein the metal of the lower surface is heavier and more dense than the metal of the upper surface.

U.S. Pat. Nos. 5,570,886 and 5,547,427 to Rigal, et al., disclose a golf club head of molded thermoplastic having a striking face defined by an impact-resistant metallic sealing element. The sealing element defines a front wall of the striking surface of the club head and extends upward and along the side of the impact surface to form a neck for attachment of the shaft to the club head. The sealing element preferably being between 2.5 and 5 mm in thickness.

U.S. Pat. No. 5,425,538 to Vincent, et al., discloses a hollow golf club head having a steel shell and a composite striking surface composed of a number of stacked woven webs of fiber.

U.S. Pat. No. 5,377,986 to Viollaz, et al., discloses a golf club head having a body composed of a series of metal plates and a hitting plate comprised of plastic or composite material wherein the hitting plate is imparted with a forwardly convex shape. Additionally, U.S. Pat. No. 5,310,185 to Viollaz, et al., discloses a hollow golf club head having a body composed of a series of metal plates, a metal support plate being located on the front hitting surface to which a hitting plate comprised of plastic or composite is attached. The metal support plate has a forwardly convex front plate associated with a forwardly convex rear plate of the hitting plate thereby forming a forwardly convex hitting surface.

U.S. Pat. No. 5,106,094 to Desboilles, et al., discloses a golf club head having a metal striking face plate wherein the striking face plate is a separate unit attached to the golf club head with a quantity of filler material in the interior portion of the club head.

U.S. Pat. No. 4,568,088 to Kurahashi discloses a wooden golf club head body reinforced by a mixture of wood-plastic composite material. The wood-plastic composite material being unevenly distributed such that a higher density in the range of between 5 and 15 mm lies adjacent to and extends substantially parallel with the front face of the club head.

U.S. Pat. No. 4,021,047 to Mader discloses a golf club wherein the sole plate, face plate, heel, toe and hosel portions are formed as a unitary cast metal piece and wherein a wood or composite crown is attached to this unitary piece thereby forming a hollow chamber in the club head.

U.S. Pat. No. 5,624,331 to Lo, et al. discloses a hollow metal golf club head where the metal casing of the head is composed of at least two openings. The head also contains a composite material disposed within the head where a portion of the composite material is located in the openings of the golf club head casing.

U.S. Pat. No. 1,167,387 to Daniel discloses a hollow golf club head wherein the shell body is comprised of metal such as aluminum alloy and the face plate is comprised of a hard wood such as beech, persimmon or the like. The face plate is aligned such that the wood grain presents endwise at the striking plate.

U.S. Pat. No. 3,692,306 to Glover discloses a golf club head having a bracket with sole and striking plates formed integrally thereon. At least one of the plates has an embedded elongate tube for securing a removably adjustable weight means.

U.S. Pat. No. 5,410,798 to Lo discloses a method of manufacturing a composite golf club head using a metal casing to which a laminated member is inserted. A sheet of composite material is subsequently layered over the openings of the laminated member and metal casing to close off the openings in the top of both. An expansible pocket is then inserted into the hollow laminated member comprising sodium nitrite, ammonium chloride and water causing the member to attach integrally to the metal casing when the head is placed into a mold and heated.

U.S. Pat. No. 4,877,249 to Thompson discloses a wood golf club head embodying a laminated upper surface and metallic sole surface having a keel. In order to reinforce the laminations and to keep the body from delaminating upon impact with an unusually hard object, a bolt is inserted through the crown of the club head where it is connected to the sole plate at the keel and tightened to compress the laminations.

U.S. Pat. No. 3,897,066 to Belmont discloses a wooden golf club head having removably inserted weight adjustment members. The members are parallel to a central vertical axis running from the face section to the rear section of the club head and perpendicular to the crown to toe axis. The weight adjustment members may be held in place by the use of capsules filled with polyurethane resin, which can also be used to form the faceplate. The capsules have openings on a rear surface of the club head with covers to provide access to adjust the weight means.

U.S. Pat. No. 2,750,194 to Clark discloses a wooden golf club head with weight adjustment means. The golf club head includes a tray member with sides and bottom for holding the weight adjustment preferably cast or formed integrally with the heel plate. The heel plate with attached weight member is inserted into the head of the golf club via an opening.

U.S. Pat. No. 5,193,811 to Okumoto, et al. discloses a wood type club head body comprised primarily of a synthetic resin and a metallic sole plate. The metallic sole plate has on its surface for bonding with the head body integrally formed members comprising a hosel on the heel side, weights on the toe and rear sides and a beam connecting the weights and hosel. Additionally, U.S. Pat. No. 5,516,107 to Okumoto, et al., discloses a golf club head having an outer shell, preferably comprised of synthetic resin, and metal weight member/s located on the interior of the club head. A foamable material is injected into the hollow interior of the club to form the core. Once the foamable material has been injected and the sole plate is attached, the club head is heated to cause the foamable material to expand thus holding the weight member/s in position in recess/es located in toe, heel and/or back side regions by pushing the weight member into the inner surface of the outer shell.

U.S. Pat. No. 4,872,685 to Sun discloses a wood type golf club head wherein a female unit is mated with a male unit to form a unitary golf club head. The female unit comprises the upper portion of the golf club head and is preferably composed of plastic, alloy, or wood. The male unit includes the structural portions of sole plate, a face insert consists of the striking plate and weighting elements. The male unit has a substantially greater weight being preferably composed of a light metal alloy. The units are mated or held together by bonding and or mechanical means.

U.S. Pat. No. 5,398,935 to Katayama discloses a wood golf club head having a striking face wherein the height of the striking face at a toe end of the golf club head is nearly equal to or greater than the height of the striking face at the center of the club head.

U.S. Pat. No. 1,780,625 to Mattern discloses a club head with a rear portion composed of a light-weight metal such as magnesium. U.S. Pat. No. 1,638,916 to Butchart discloses a golf club with a balancing member composed of persimmon or a similar wood material, and a shell-like body composed of aluminum attached to the balancing member.

The Rules of Golf, established and interpreted by the United States Golf Association (USGA) and The Royal and Ancient Golf Club of Saint Andrews, set forth certain requirements for a golf club head. The requirements for a golf club head are found in Rule 4 and Appendix II. A complete description of the Rules of Golf are available on the USGA web page at www.usga.org. Although the Rules of Golf do not expressly state specific parameters for a golf club face, Rule 4-1e prohibits the face from having the effect at impact of a spring with a golf ball. In 1998, the USGA adopted a test procedure pursuant to Rule 4-1e which measures club face COR. This USGA test procedure, as well as procedures like it, may be used to measure club face COR.

Although the prior art has disclosed many variations of multiple material club heads, the prior art has failed to provide a multiple material club head with a high coefficient of restitution and greater forgiveness for the typical golfer.

SUMMARY OF INVENTION

One aspect of the present invention is a golf club head composed of a metal face component and light-weight aft body, and having a coefficient of restitution of at least 0.81 under test conditions, such as those specified by the USGA. The standard USGA conditions for measuring the coefficient of restitution is set forth in the *USGA Procedure for Measuring the Velocity Ratio of a Club Head for Conformance to Rule* 4-1e, *Appendix II. Revision I,* Aug. 4, 1998 and *Revision* 0, Jul. 6, 7998, available from the USGA.

Yet another aspect of the present invention is a golf club head including a face component composed of a metal material and an aft-body composed of a non-metal material. The face component has a striking plate portion and a return portion. The striking plate portion has a thickness in the range of 0.010 inch to 0.250 inch. The return portion has a thickness in the range of 0.010 inch to 0.200 inch. The aft body has a crown portion, a sole portion and a ribbon portion. The aft-body is attached to the return portion of the face component. The golf club head has a coefficient of restitution of 0.81 to 0.94.

Yet another aspect of the present invention is golf club head including a face component composed of a metal material and an aft-body composed of a plurality of plies of pre-preg. The face component has a striking plate portion and a return portion. The aft body has a crown portion, a sole portion and a ribbon portion. The aft-body is attached to the return portion of the face component. The moment of inertia of the golf club head about the Izz axis through the center of gravity is greater than 3000 grams—centimeter squared, and the moment of inertia about the Iyy axis through the center of gravity is greater than 1800 grams—centimeter squared.

Yet another aspect of the present invention is a golf club head having a face component composed of a forged titanium alloy material and an aft body composed of a plurality of plies of pre-preg. The face component has a return portion and a striking plate portion. The striking plate portion has concentric regions of varying thickness with the thickest region about the center of the striking plate portion. The striking plate portion extends from a heel section of the golf club head to a toe section of the golf club head and has an aspect ratio no greater than 1.7. The return portion extends laterally inward at least 0.250 inch from a perimeter of the striking plate portion. The return portion extends laterally inward 360 degrees of the perimeter of the striking plate portion. The golf club head also has an interior tubing for receiving a shaft. The interior tubing engages an upper section of the return portion and a lower section of the return portion. The aft body has a thickness ranging from 0.010 inch to 0.100 inch. The aft body includes a crown portion, a ribbon portion and a sole portion. The crown portion is attached to the upper section of the return portion. The sole portion is attached to the lower section of the return portion. A heel end of the ribbon portion is attached to a heel section of the return portion. A toe end of the ribbon portion is attached to a toe section of the return portion. The golf club head has a hollow interior, a volume ranging from 280 cubic centimeters to 600 cubic centimeters, a mass ranging from 175 grams to 225 grams, and a coefficient of restitution ranging from 0.81 to 0.94.

Having briefly described the present invention, the above and further objects, features and advantages thereof will be recognized by those skilled in the pertinent art from the following detailed description of the invention when taken in conjunction with the accompanying drawings.

DETAILED DESCRIPTION

Figure 1:
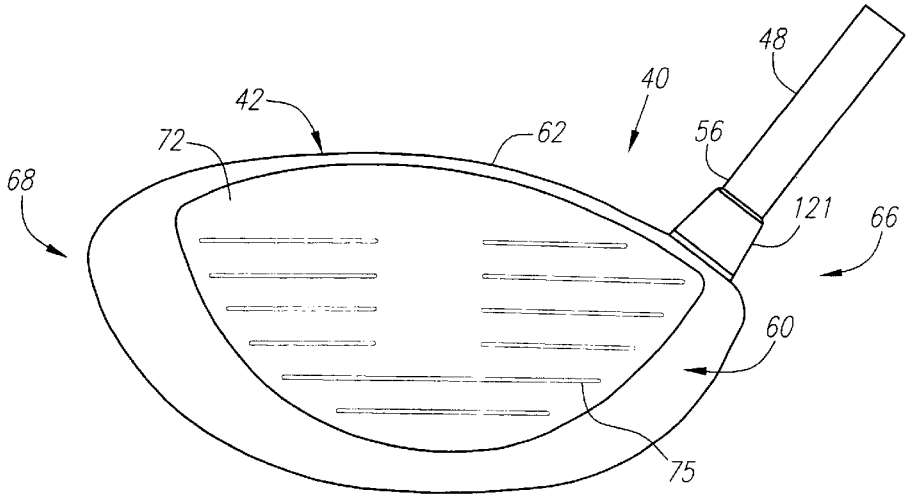
FIG. 1 is a front view of the golf club of the present invention.

As shown in FIGS. 1–5, a golf club is generally designated 40. The golf club 40 has a golf club head 42 with a hollow interior, not shown. Engaging the club head 42 is a shaft 48 that has a grip 50, not shown, at a butt end 52 and is inserted into a hosel 54 at a tip end 56.

The club head 42 is generally composed of two components, a face component 60, and an aft-body 61. The aft-body 61 has a crown portion 62 and a sole portion 64. The club head 42 may also be partitioned into a heel section 66 nearest the shaft 48, a toe section 68 opposite the heel section 66, and a rear section 70 opposite the face component 60.

The face component 60 is generally composed of a single piece of metal, and is preferably composed of a forged metal material. More preferably, the forged metal material is a forged titanium material. Such titanium materials include pure titanium and titanium alloys such as 6-4 titanium alloy, SP-700 titanium alloy (available from Nippon Steel of Tokyo, Japan), DAT 55G titanium alloy available from Diado Steel of Tokyo, Japan, Ti 10-2-3 Beta-C titanium alloy available from RTI International Metals of Ohio, and the like. Other metals for the face component 60 include stainless steel, other high strength steel alloy metals and amorphous metals. Further, the face component 60 may be manufactured through casting, forming, machining, powdered metal forming, metal-injection-molding, electro chemical milling, and the like.

FIGS. 13, 13A, 13B, 13C, 13D, 13E and 13F illustrate the face component 60. The face component 60 generally includes a striking plate portion (also referred to herein as a face plate) 72 and a return portion 74 extending laterally inward from the perimeter of the striking plate portion 72. The striking plate portion 72 typically has a plurality of scorelines 75 thereon.

In a preferred embodiment, the return portion 74 generally includes an upper lateral section 76, a lower lateral section 78, a heel lateral section 80 and a toe lateral section 82. Thus, the return 74 preferably encircles the striking plate portion 72 a full 360 degrees. However, those skilled in the pertinent art will recognize that the return portion 74 may only encompass a partial section of the striking plate portion 72, such as 270 degrees or 180 degrees, and may also be discontinuous.

The upper lateral section 76 extends inward, towards the aft-body 61, a predetermined distance, d, to engage the crown 62. In a preferred embodiment, the predetermined distance ranges from 0.2 inch to 1.0 inch, more preferably 0.40 inch to 0.75 inch, and most preferably 0.68 inch, as measured from the perimeter 73 of the striking plate portion 72 to the rearward edge of the upper lateral section 76. In a preferred embodiment, the upper lateral section 76 has a general curvature from the heel section 66 to the toe section 68. The upper lateral section 76 has a length from the perimeter 73 of the striking plate section 72 that is preferably a minimal length near the center of the striking plate section 72, and increases toward the toe section 68 and the heel section 66.

The perimeter 73 of the striking plate portion 74 is defined as the transition point where the face component 60 transitions from a plane substantially parallel to the striking plate portion 72 to a plane substantially perpendicular to the striking plate portion 72. Alternatively, one method for determining the transition point is to take a plane parallel to the striking plate portion 72 and a plane perpendicular to the striking plate portion, and then take a plane at an angle of forty-five degrees to the parallel plane and the perpendicular plane. Where the forty-five degrees plane contacts the face component is the transition point thereby defining the perimeter of the striking plate portion 72.

The present invention has the face component 60 engage the crown 62 along a substantially horizontal plane. The crown 62 has a crown undercut portion 62*a*, which is placed under the return portion 74. Such an engagement enhances the flexibility of the striking plate portion 72 allowing for a greater coefficient of restitution. The crown 62 and the upper lateral section 76 are attached to each other as further explained below.

The heel lateral section 80 is substantially perpendicular to the striking plate portion 72, and the heel lateral section 80 covers the hosel 54 before engaging an optional ribbon section 90 and a bottom section 91 of the sole portion 64 of the aft-body 61. The heel lateral section 80 is attached to the sole 64, both the ribbon 90 and the bottom section 91, as explained in greater detail below. The heel lateral section 80 extends inward a distance, d''', from the perimeter 73 a distance of 0.250 inch to 1.50 inches, more preferably 0.50 inch to 1.0 inch, and most preferably 0.950 filch. The heel lateral section 80 preferably has a general curvature at its edge.

At the other end of the face component 60 is the toe lateral section 82. The toe lateral section 82 is attached tote sole 64, both the ribbon 90 and the bottom section 91, as explained in greater detail below. The toe lateral section 82 extends inward a distance, d'', from the perimeter 73 a distance of 0.250 inch to 1.50 inches, more preferably 0.75 inch to 1.30 inch, and most preferably 1.20 inch. The toe lateral section 80 preferably has a general curvature at its edge.

The lower lateral section 78 extends inward, toward the aft-body 61, a predetermined distance, d', to engage the sole 64. In a preferred embodiment, the predetermined distance ranges from 0.2 inch to 1.25 inches, more preferably 0.50 inch to 1.10 inch, and most preferably 0.9 inch, as measured from the perimeter 73 of the striking plate portion 72 to the edge of the lower lateral section 78. In a preferred embodiment, the lower lateral section 78 has a general curvature from the heel section 66 to the toe section 68. The lower lateral section 78 has a length from the perimeter 73 of the striking plate section 72 that is preferably a minimal length near the center of the striking plate section 72, and increases toward the toe section 68 and the heel section 66.

The sole portion 64 has a sole undercut 64*a* for placement under the return portion 74. The sole 64 and the lower lateral section 78, the heel lateral section 80 and the toe lateral section 82 are attached to each other as explained in greater detail below.

The aft-body 61 is preferably composed of a non-metal material, preferably a composite material such as continuous fiber pre-preg material (including thermosetting materials or a thermoplastic materials for the resin). Other materials for the aft-body 61 include other thermosetting materials or other thermoplastic materials such as injectable plastics. The aft-body 61 is preferably manufactured through bladder-molding, resin transfer molding, resin infusion, injection molding, compression molding, or a similar process. In a preferred process, the face component 60, with an adhesive on the interior surface of the return portion 74, is placed within a mold with a preform of the aft-body 61 for bladder molding. The return portion 74 is placed and fitted into the undercut portions 62*a* and 64*a*. Also, the adhesive may be placed on the undercut portions 62*a* and 64*a*. Such adhesives include thermosetting adhesives in a liquid or a film medium. A preferred adhesive is a two part liquid epoxy sold by 3M of Minneapolis Minn. under the brand names DP420NS and DP460NS. Other alternative adhesives include modified acrylic liquid adhesives such as DP810NS, also sold by the 3M company. Alternatively, foam tapes such as Hysol Synspan may be utilized with the present invention.

A bladder is placed within the hollow interior of the preform and face component 60, and is pressurized within the mold, which is also subject to heating. The co-molding process secures the aft-body 61 to the face component 60. Alternatively, the aft-body 61 is bonded to the face component 60 using an adhesive, or mechanically secured to the return portion 74.

Figures 7, 8, 9:
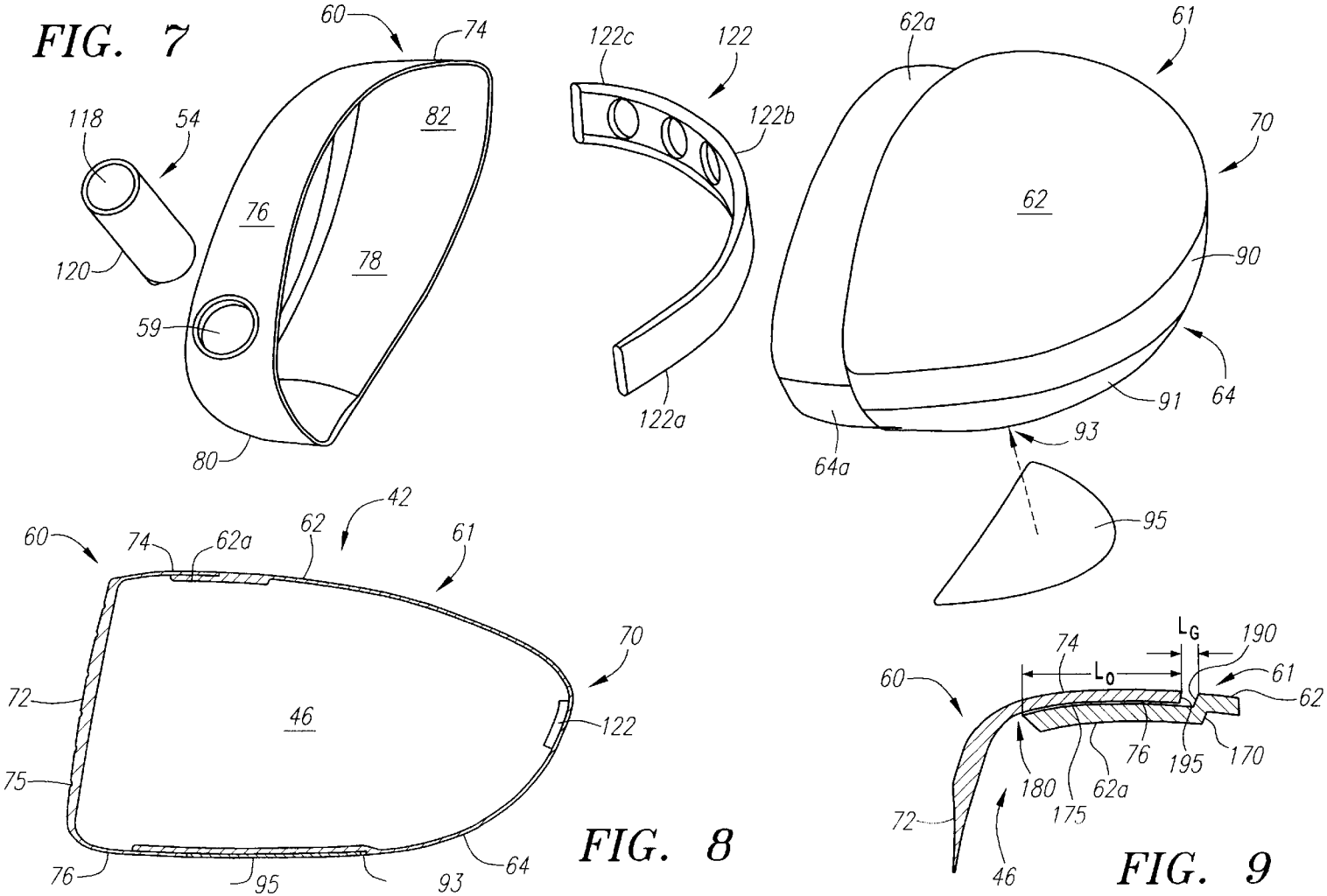
FIG. 7 is an exploded view of the golf club head of the present invention.
FIG. 8 is a cross-sectional view of the golf club head of FIG. 5.
FIG. 9 is an isolated cross-sectional view of the face component overlapping the aft body.

As shown in FIG. 9, the return portion 74 overlaps the undercut portions 62*a* and 64*a* a distance Lo, which preferably ranges from 0.25 inch to 1.00 inch, more preferably ranges from 0.40 inch to 0.70 inch, and is most preferably 0.50 inch. An annular gap 170 is created between an edge 190 of the crown portion 62 and the sole portion 64, and an edge 195 of the return portion 74. The annular gap 170 has a distance Lg that preferably ranges from 0.020 inch to 0.100 inch, more preferably from 0.050 inch to 0.070 inch, and is most preferably 0.060 inch. A projection 175 from an upper surface of the undercut portions 62*a* and 64*a* establishes a minimum bond thickness between the interior surface of the return portion 74 and the upper surface of the undercut portions 62*a* and 64*a*. The bond thickness preferably ranges from 0.002 inch to 0.100 inch, more preferably ranges from 0.005 inch to 0.040 inch, and is most preferably 0.030 inch. A liquid adhesive 200 preferably secures the aft body 61 to the face component 60. A leading edge 180 of the undercut portions 62*a* and 64*a* may be sealed to prevent the liquid adhesive from entering the hollow interior 46.

FIGS. 14, 14A, 14B, 14C 14D, 14E, 14F and 14G illustrate a preferred embodiment of the aft-body 61. The crown portion 62 of the aft-body 61 is generally convex toward the sole 64, and engages the ribbon 90 of sole 64 outside of the engagement with the face member 60. The crown portion 62 preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch. The sole portion 64, including the bottom section 91 and the optional ribbon 90 which is substantially perpendicular to the bottom section 91, preferably has a thickness in the range of 0.010 to 0.100 inch, more preferably in the range of 0.025 inch to 0.070 inch, even more preferably in the range of 0.028 inch to 0.040 inch, and most preferably has a thickness of 0.033 inch.

In a preferred embodiment, the aft-body is composed of a plurality of plies of pre-preg, typically six or seven plies, such as disclosed in U.S. Pat. No. 6,248,025, entitled Composite Golf Head And Method Of Manufacturing, which is hereby incorporated by reference in its entirety. The bottom section 91 is generally convex toward the crown portion 62. The sole portion 64 of the aft-body 61 optionally has a recess 93 for attachment of a sole plate 95 thereto. The sole plate is preferably attached with a pressure sensitive adhesive such as a polyethylene foam acrylic adhesive sold by the 3M company. The sole plate 95 is preferably composed of a light weight metal such as aluminum, titanium or titanium alloy. Alternatively, the sole plate 95 is composed of a durable plastic material. The sole plate 95 may have graphics thereon for designation of the brand of club and loft.

FIG. 8 illustrates the hollow interior 46 of the club head 42 of the present invention. The hosel 54 is disposed within the hollow interior 46, and is located as a part of the face component 60. The hosel 54 may be composed of a similar material to the face component 60, and is preferably secured to the face component 60 through welding or the like. The hosel 54 may also be formed with the formation of the face component 60. Additionally, the hosel may be composed of a non-similar material that is light weight and secured using bonding or other mechanical securing techniques. A hollow interior 118 of the hosel 54 is defined by a hosel wall 120 that forms a tapering tube from the aperture 59 to the sole potion 64. In a preferred embodiment, the hosel wall 120 does not engage the heel lateral section 80 thereby leaving a void 115 between the hosel wall 120 and the heel lateral section 80. The shaft 48 is disposed within a hosel insert 121 that is disposed within the beset 54. Such a hosel insert 121 and hosel 54 are described in U.S. Pat. No. 6,352,482, filed on Aug. 31, 2000, entitled Golf Club With Hosel Liner, which pertinent parts are hereby incorporated by reference. Further, the hosel 54 is located rearward from the striking plate portion 72 in order to allow for compliance of the striking plate portion 72 during impact with a golf ball. In one embodiment, the hosel 54 is disposed 0.125 inch rearward from the striking plate portion 72.

As shown in FIG. 7, a weighting member 122 is preferably disposed within the hollow interior 46 of the club head 42. In a preferred embodiment, the weighting member 122 is disposed on the interior surface of the ribbon section 90 of the sole portion 64 in order to increase the moment of inertia and control the center of gravity of the golf club head 42. However, alternative embodiments may not have weighting members 122 due to the mass of the face component 60. Additionally, those skilled in the pertinent art will recognize that the weighting member 122, and additional weighting members 122 may be placed in other locations of the club head 42 in order to influence the center of gravity, moment of inertia, or other inherent properties of the golf club head 42. The weighting member 122 is preferably tungsten loaded film, tungsten doped polymers, or similar weighting mechanisms such as described in U.S. Pat. No. 6,386,990, entitled A Composite Golf Club Head With An Integral Weight Strip, and hereby incorporated by reference in its entirety. Those skilled in the pertinent art will recognize that other high density materials may be utilized as an optional weighting member without departing from the scope and spirit of the present invention.

In a preferred embodiment, the weight member 122 is composed of three weighting components 122*a*, 122*b* and 122*c*, which are embedded within the plies of pre-preg of the ribbon section 90 of the sole portion 64 of the aft-body 61. A heel weight component 122*a*, a center weight component 122*b* and a toe weight component 122*c* are all disposed within the plies of pre-preg that compose the ribbon section 90. Individually, each of the weight components 122*a–c* has a mass ranging from 10 grams to 30 grams, preferably from 14 grams to 25 grams, and more preferably from 15 grams to 20 grams. Each of the weight components 122*a–c* has a density ranging from 5 grams per cubic centimeters to 20 grams per cubic centimeters, more preferably from 7 grams per cubic centimeters to 12 grams per cubic centimeters, and most preferably 8.0 grams per cubic centimeters.

Each of the weight components 122*a–c* is preferably composed of a polymer material integrated with a metal material. The metal material is preferably selected from copper, tungsten, steel, aluminum, tin, silver, gold, platinum, or the like. A preferred metal is tungsten due to its high density. The polymer material is a thermoplastic or thermosetting polymer material. A preferred polymer material is polyurethane, epoxy, nylon, polyester, or similar materials. A most preferred polymer material is a thermoplastic polyurethane. A preferred weight component 122*a*, 122*b* or 122*c* is an injection molded thermoplastic polyurethane integrated with tungsten to have a density of 8.0 grams per cubic centimeters. In a preferred embodiment, each of the weight components 122*a–c* are composed of from 50 to 95 volume percent polyurethane and from 50 to 5 volume percent tungsten. Also, in a preferred embodiment, each of the weight components 122*a–c* are composed of from 10 to 25 weight percent polyurethane and from 90 to 75 weight percent tungsten.

Preferably, the weight components 122*a–c* extend from approximately the heel section 66 of the striking plate portion 72 through the rear section 70 to the toe section 68 of the striking plate portion 72. However, the weight components 122*a–c* may only extend along the rear section 70 of the ribbon section 90, the heel section 66 of the ribbon section 90, the toe section 68 of the ribbon section 90, or any combination thereof. Also, the weight components 122*a–c* may be positioned parallel to each other as opposed to being positioned in series. Those skilled in the pertinent art will recognize that other weighting materials may be utilized for the weight components 122*a–c* without departing from the scope and spirit of the present invention. The placement of the weighting components 122*a–c* allows for the moment of inertia of the golf club head 40 to be optimized.

Figure 12:
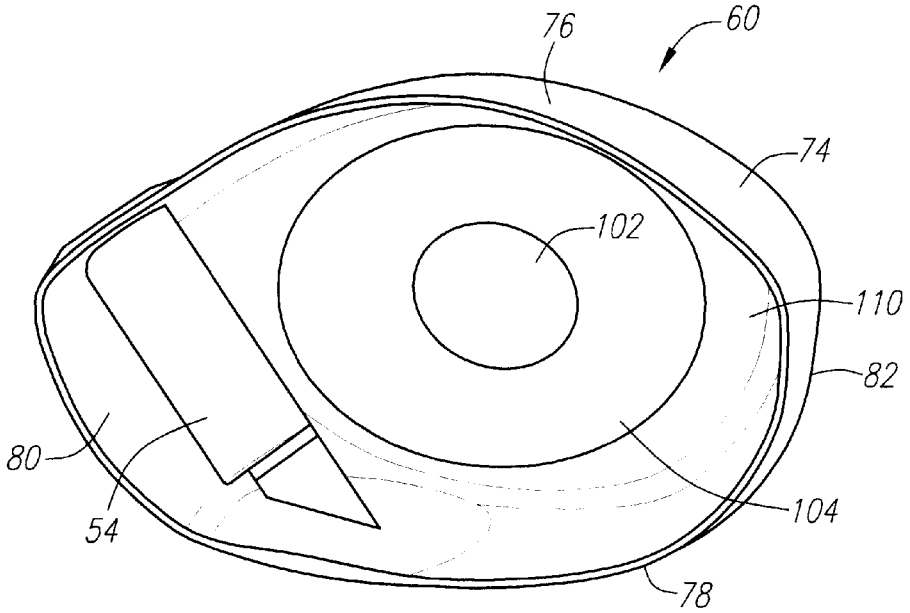
FIG. 12 is an isolated view of the interior of the face component of the golf club head of the present invention illustrating the variations in thickness of the striking plate portion.

FIG. 12 illustrates a preferred embodiment of the face component of the golf club head of the present invention. FIG. 12 illustrates the variation in the thickness of the striking plate portion 72. The striking plate portion 72 is preferably partitioned into elliptical regions, each having a different thickness. In a preferred embodiment in which the face component 60 is composed of a titanium or titanium alloy material, a central elliptical region 102 preferably has the greatest thickness that ranges from 0.120 inch to 0.090 inch, preferably from 0.115 inch to 0.100 inch, and is most preferably 0.105 inch. The central elliptical region 102 preferably has a uniform thickness. A first concentric region 104 preferably has the next greatest thickness that ranges from 0.110 inch to 0.076 inch, preferably from 0.100 inch to 0.086 inch, and is most preferably 0.088 inch. The first concentric region preferably has a thickness that transitions from the first concentric region 102 thickness to the periphery region 110 thickness. A periphery region 110 preferably has the next greatest thickness that ranges from 0.082 inch to 0.062 inch, and is most preferably 0.072 inch. The variation in the thickness of the striking plate portion 72 allows for the greatest thickness to be localized in the center 111 of the striking plate portion 72 thereby maintaining the flexibility of the striking plate portion 72 which corresponds to less energy loss to a golf ball and a greater coefficient of restitution without reducing the durability of the striking plate portion 72.

Figure 12A:
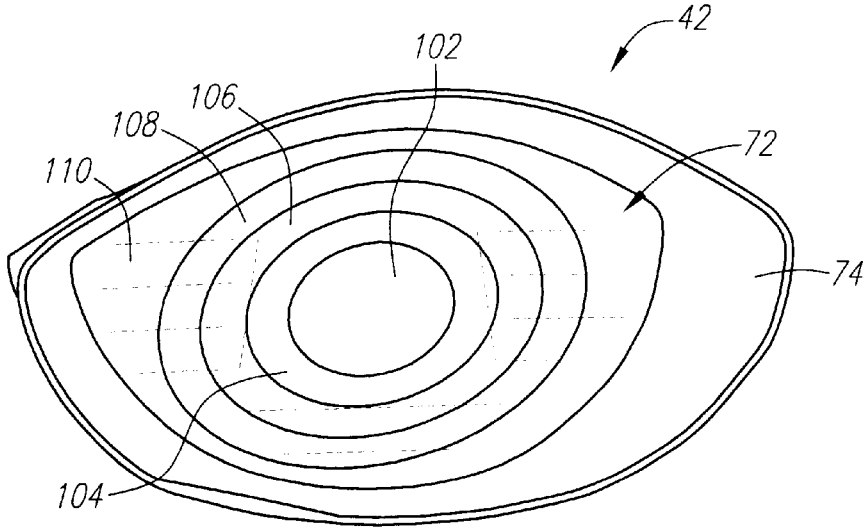
FIG. 12A is an isolated view of the interior of an alternative face component of the golf club head of the present invention illustrating the variations in thickness of the striking plate portion.
Figure 13:
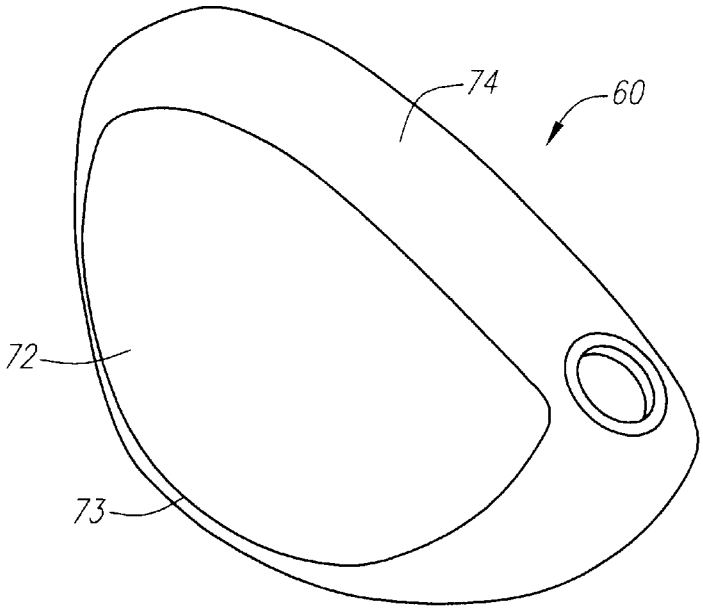
FIG. 13 is an isolated top perspective view of a face component of the golf club head of the present invention.
Figure 13A:
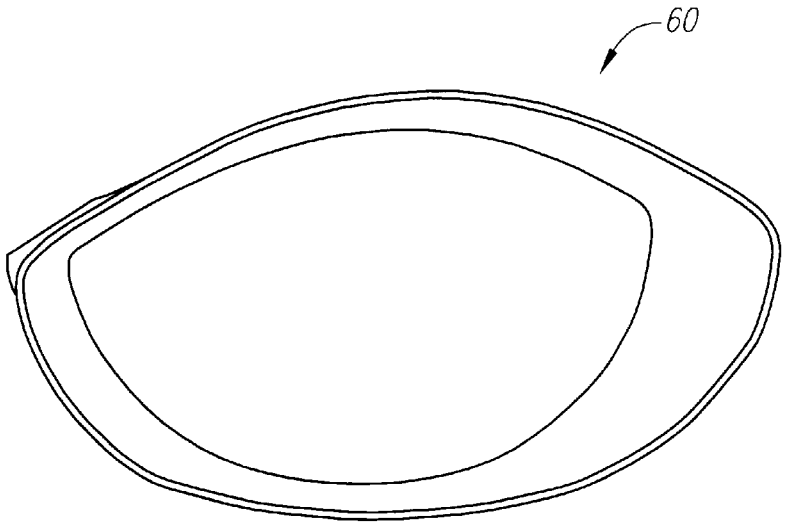
FIG. 13A is an interior view of the face component of FIG. 13.
Figure 13B:
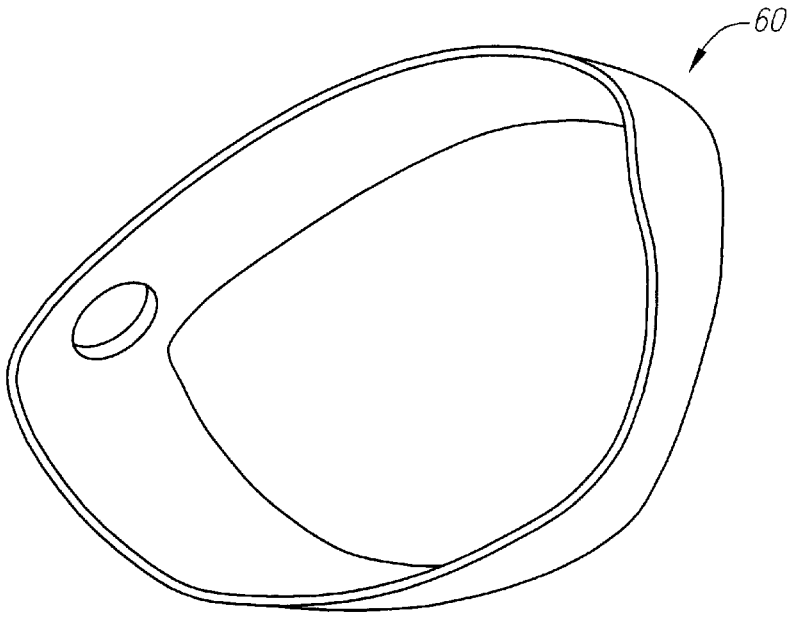
FIG. 13B is an interior view of the face component of FIG. 13.
Figure 13C:
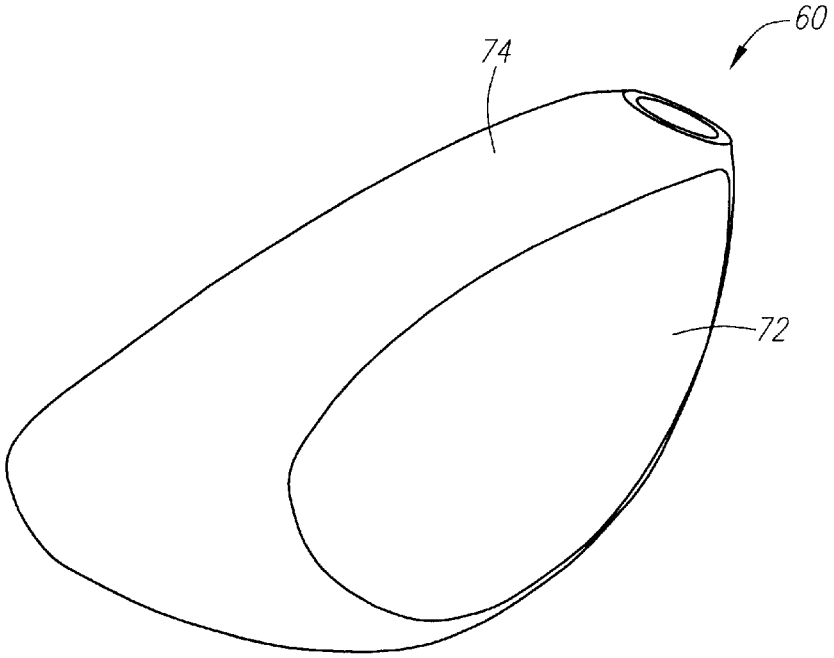
FIG. 13C is another perspective view of the face component of FIG. 13.
Figure 13D:
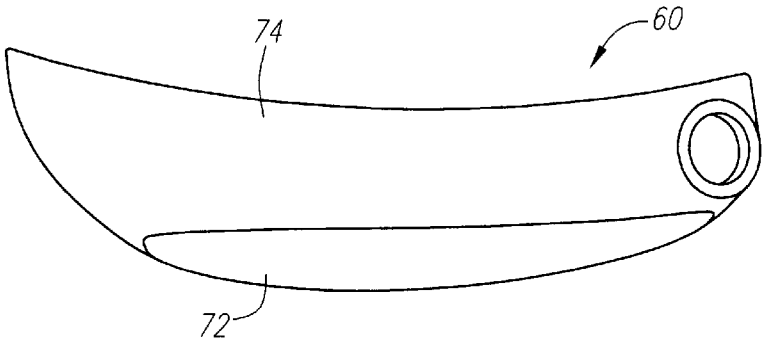
FIG. 13D is a top plan view of the face component of FIG. 13.
Figure 13E:
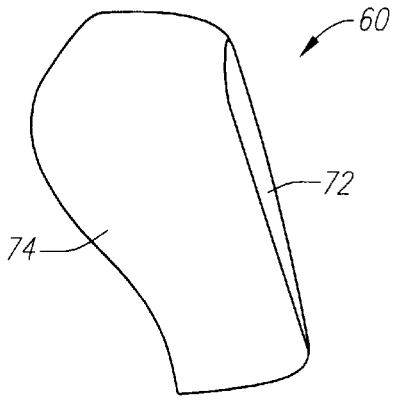
FIG. 13E is a toe side view of the face component of FIG. 13.
Figure 13F:
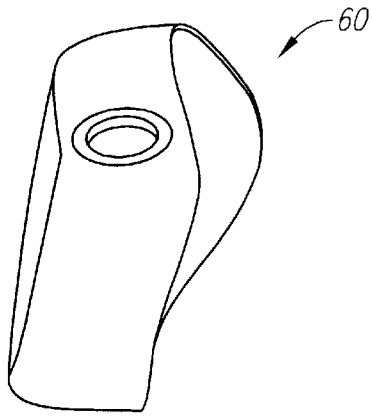
FIG. 13F is a heel side view of the face component of FIG. 13.
Figure 14:
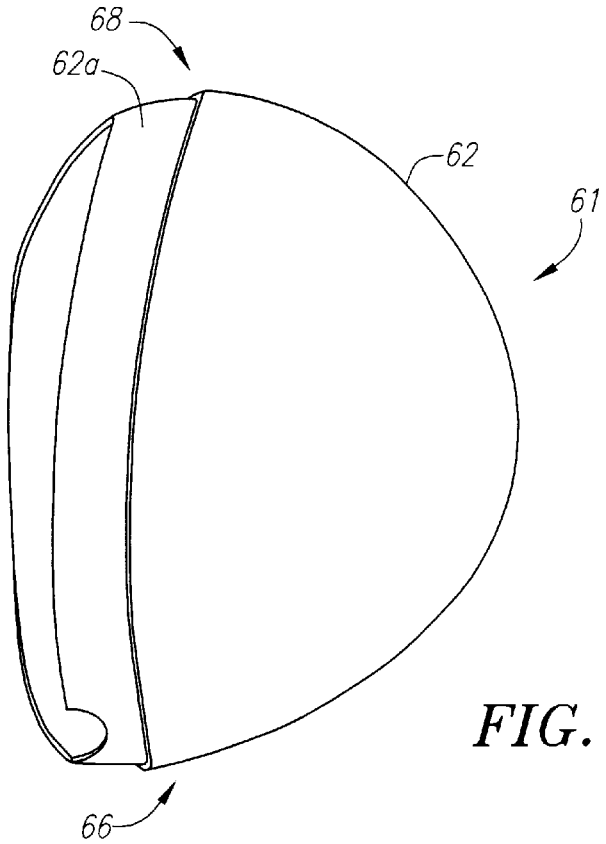
FIG. 14 is an isolated top plan view of the aft-body of the golf club head of the present invention.
Figure 14A:
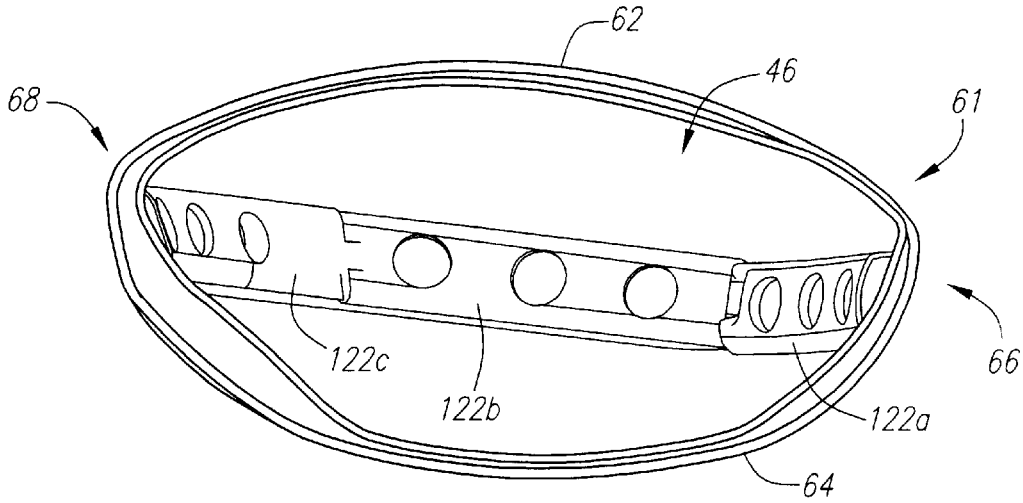
FIG. 14A is an interior view of the aft-body of FIG. 14.
Figure 14B:
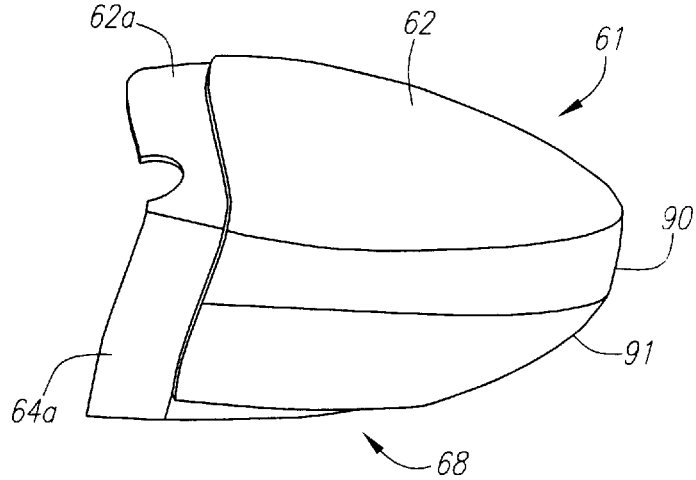
FIG. 14B is a heel side view of the aft-body of FIG. 14.
Figure 14C:
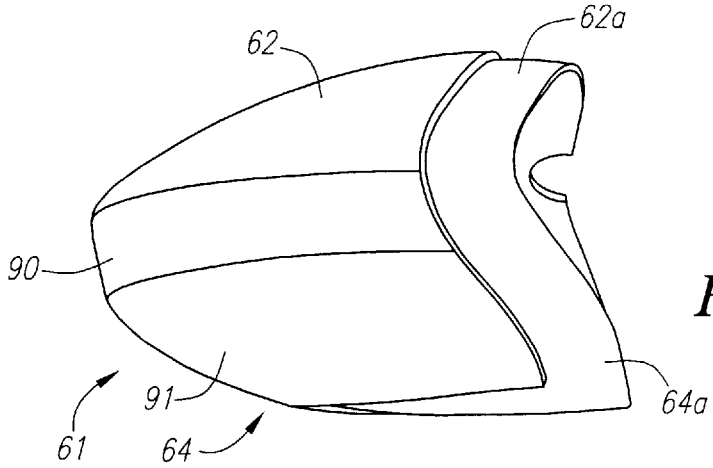
FIG. 14C is a toe side view of the aft-body of FIG. 14.
Figure 14D:
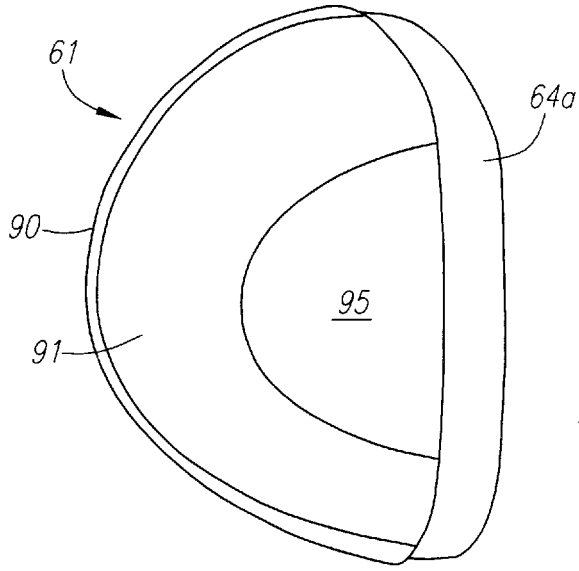
FIG. 14D is a bottom plan view of the aft-body of FIG. 14.
Figure 14E:
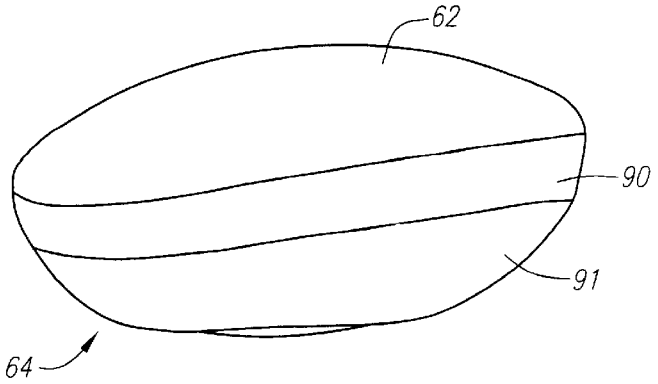
FIG. 14E is a rear view of the aft-body of FIG. 14.
Figure 14F:
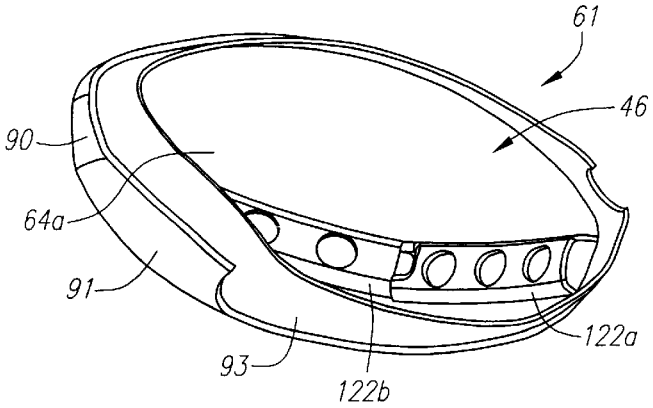
FIG. 14F is an interior view of the aft-body of FIG. 14.
Figure 14G:
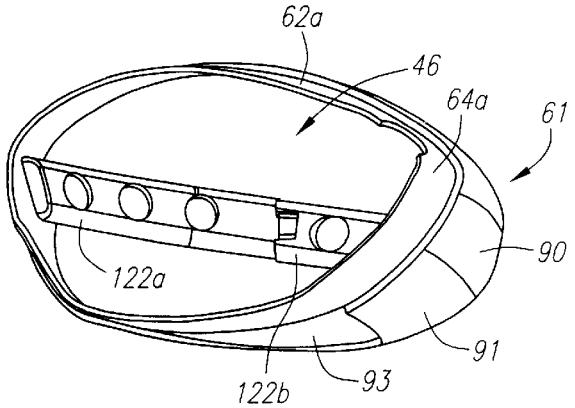
FIG. 14G is an interior view of the aft-body of FIG. 14.

FIG. 12A illustrates an alternative embodiment for the face component 60. In this embodiment, the striking plate portion 72 has an central elliptical region 102 which preferably has the greatest thickness that ranges from 0.120 inch to 0.090 inch, preferably from 0.115 inch to 0.100 inch, and is most preferably 0.105 inch. The central elliptical region 102 preferably has a uniform thickness. A first concentric region 104 preferably has the next greatest thickness that ranges from 0.110 inch to 0.090 inch, preferably from 0.104 inch to 0.094 inch, and is most preferably 0.098 inch. A second concentric region 106 preferably has the next greatest thickness that ranges from 0.100 inch to 0.080 inch, preferably from 0.095 inch to 0.085 inch, and is most preferably 0.088 inch. A third concentric region 108 preferably has the next greatest thickness that ranges from 0.090 inch to 0.070 inch, preferably from 0.083 inch to 0.073 inch, and is most preferably 0.080 inch. The concentric regions preferably each have a thickness that transitions from one adjacent region to another. A periphery region 110 preferably has the next greatest thickness that ranges from 0.072 inch to 0.061 inch. The periphery region includes toe periphery region 110*a* and heel periphery region 110*b*. The variation in the thickness of the striking plate portion 72 allows for the greatest thickness to be distributed in the center 111 of the striking plate portion 72 thereby enhancing the flexibility of the striking plate portion 72 which corresponds to less energy loss to a golf ball and a greater coefficient of restitution.

As mentioned previously, the face component 60 is preferably forged from a rod of metal material. One preferred forging process for manufacturing the face component is set forth in U.S. Pat. No. 6,440,011, entitled Method For Processing A Striking Plate For A Golf Club Head, and hereby incorporated by reference in its entirety. Alternatively, the face component 60 is cast from molten metal in a method such as the well-known lost-wax casting method. The metal for forging or casting is preferably titanium or a titanium alloy such as 6-4 titanium alloy, alpha-beta titanium alloy or beta titanium alloy for forging, and 6-4 titanium for casting.

Additional methods for manufacturing the face component 60 include forming the face component 60 from a flat sheet of metal, super-plastic forming the face component 60 from a flat sheet of metal, machining the face component 60 from a solid block of metal, electrochemical milling the face from a forged pre-form, and like manufacturing methods. Yet further methods include diffusion bonding titanium sheets to yield a variable face thickness face and then superplastic forming.

The present invention is directed at a golf club head that has a high coefficient of restitution Thereby enabling for greater distance of a golf ball hit with the golf club head of the present invention. The coefficient of restitution (also referred to herein as "COR") is determined by the following equation:

$$e = \frac{v_2 - v_1}{U_1 - U_2}$$

wherein $U_1$ is the club head velocity prior to impact; $U_2$ is the golf ball velocity prior to impact which is zero; $v_1$ is the club head velocity just after separation of the golf bail from the face of the club head; $v_2$ is the golf ball velocity just after separation of the golf ball from the face of The club head; and e is the coefficient of restitution between the golf ball and the club face.

The values of e are limited between zero and 1.0 for systems with no energy addition. The coefficient of restitution, e, for a material such as a soft clay or putty would be near zero, while for a perfectly elastic material, where no energy is lost as a result of deformation, the value of e would be 1.0. The present invention provides a club head having a coefficient of restitution ranging from 0.81 to 0.94, as measured under conventional test conditions.

The coefficient of restitution of the club head 42 of the present invention under standard USGA test conditions with a given ball ranges from approximately 0.81 to 0.94, preferably ranges from 0.83 to 0.883 and is most preferably 0.87.

Figure 1A:
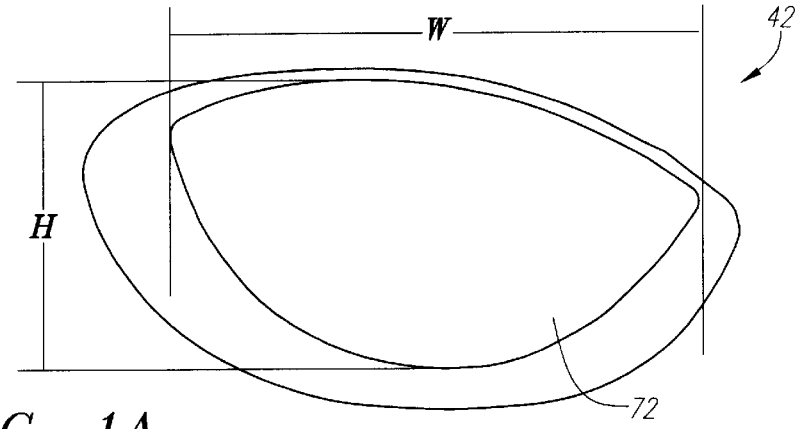
FIG. 1A is a front view of the golf club of the present invention showing the measurement for the aspect ratio.
Figure 2:
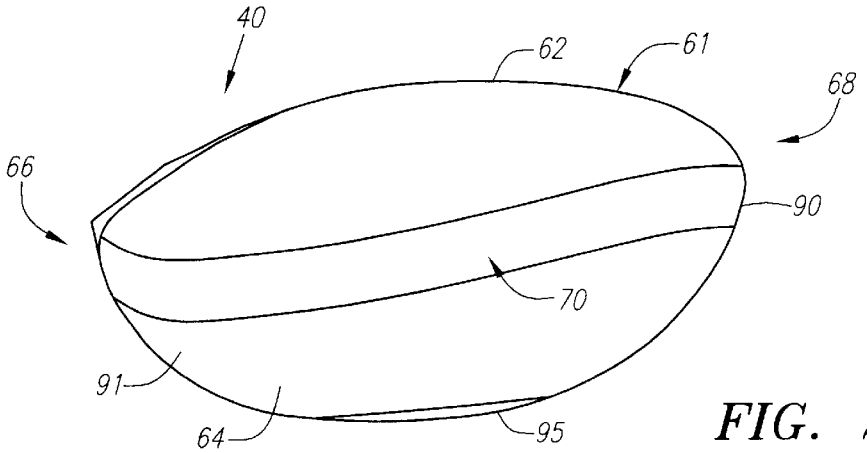
FIG. 2 is a rear view of the golf club head of FIG. 1.
Figure 3:
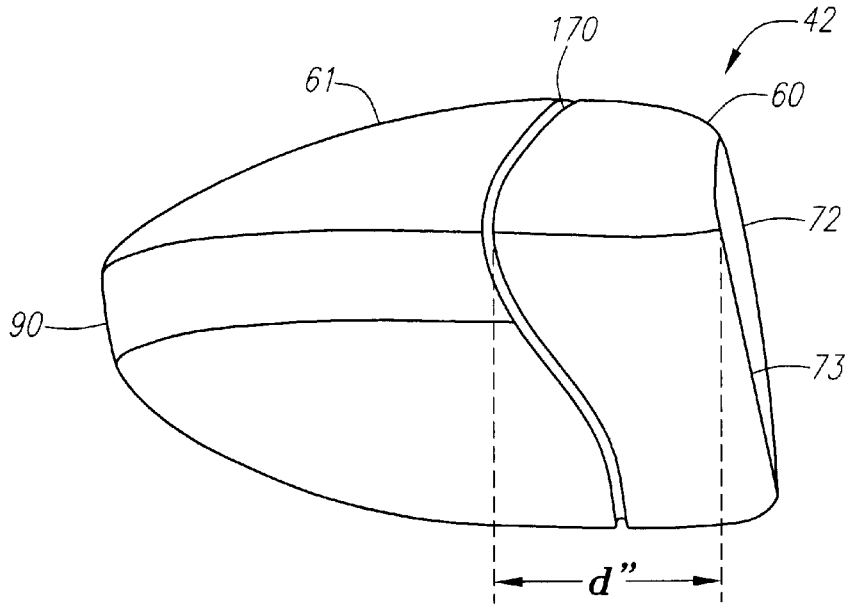
FIG. 3 is toe side view of the golf club head of FIG. 1.
Figure 4:
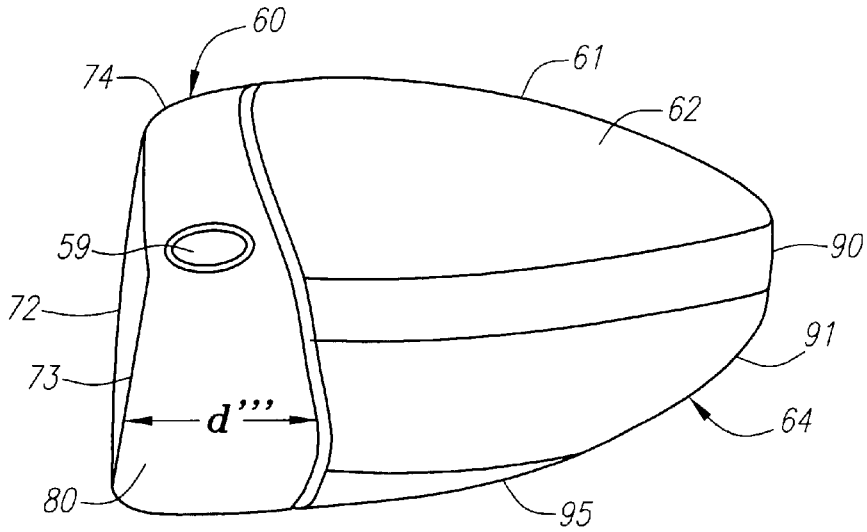
FIG. 4 is a heel side plan view of the golf club head of FIG. 1.
Figure 5:
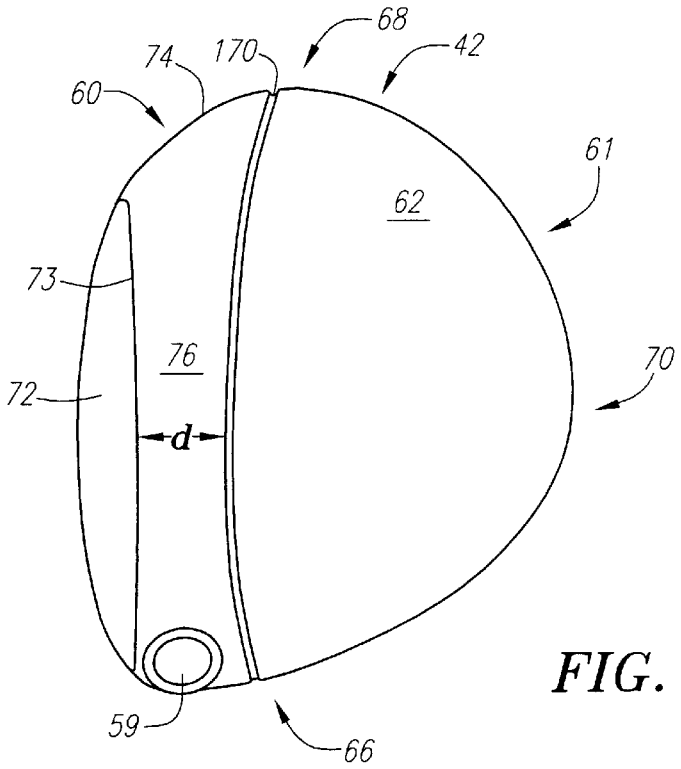
FIG. 5 is a top plan view of the golf club head of FIG. 1.
Figure 6:
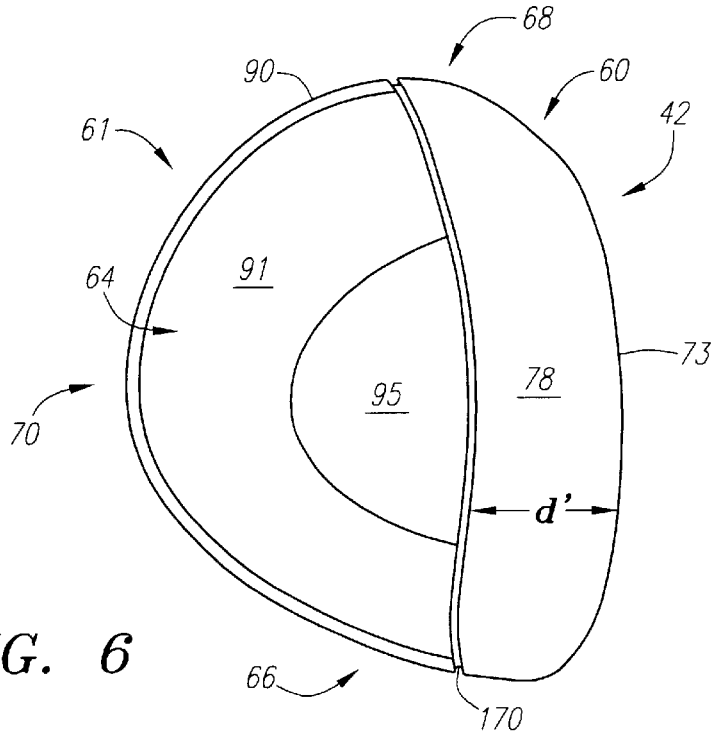
FIG. 6 is a bottom view of the golf club head of FIG. 1.

Additionally, the striking plate portion 72 of the face component 60 has a smaller aspect ratio than face plates of the prior art. The aspect ratio as used herein is defined as the width, w, of the face divided by the height, h, of the face, as shown in FIG. 1A. In one preferred embodiment, the width w is 78 millimeters and the height h is 48 millimeters giving an aspect ratio of 1.625. In conventional golf club heads, the aspect ratio is usually much greater than 1. For example, the original GREAT BIG BERTHA® driver had an aspect ratio of 1.9. The striking plate portion 72 of the present invention has an aspect ratio that is no greater than 1.7. The aspect ratio of the present invention preferably ranges from 1.0 to 1.7. One embodiment has an aspect ratio of 1.3. The striking plate portion 72 of the present invention is more circular than faces of the prior art. The face area of the striking plate portion 72 of the present invention ranges from 4.00 square inches to 7.50 square inches, more preferably from 5.00 square inches to 6.5 square inches, and most preferably from 5.8 square inches to 6.0 square inches.

The club head 42 of the present invention also has a greater volume than a club head of the prior art while maintaining a weight that is substantially equivalent to that of the prior art. The volume of the club head 42 of the present invention ranges from 290 cubic centimeters to 600 cubic centimeters, and more preferably ranges from 350 cubic centimeters to 510 cubic centimeters, even preferably 360 cubic centimeters to 395 cubic centimeters, and most preferably 385 cubic centimeters.

The mass of the club head 42 of the present invention ranges from 165 grams to 225 grams, preferably ranges from 175 grams to 205 grams, and most preferably from 190 grams to 200 grams. Preferably, the face component 60 has a mass ranging from 50 grams to 110 grams, more preferably ranging from 65 grams to 95 grams, yet more preferably from 70 grams to 90 grams, and most preferably 78 grams. The aft-body 61 (without weighting) has a mass preferably ranging from 10 grams to 60 grams, more preferably from 15 grams to 50 grams, and most preferably 35 grams to 40 grams. The weighting member 122 (preferably composed of three separate weighting members 122*a*, 122*b* and 122*c*) has a mass preferably ranging from 30 grams to 120 grams, more preferably from 50 grams to 80 grams, and most preferably 60 grams. The interior hosel 54 preferably a mass preferably ranging from 3 grams to 20 grams, more preferably from 5 grams to 15 grams, and most preferably 12 grams. The sole plate 95 preferably a mass preferably ranging from 3 grams to 20 grams, more preferably from 5 grams to 15 grams, and most preferably 8 grams. Additionally, epoxy, or other like flowable materials, in an amount ranging from 0.5 grams to 5 grams, may be injected into the hollow interior 46 of the golf club head 42 for selective weighting thereof.

The depth of the club head 42 from the striking plate portion 72 to the rear section of the crown portion 62 preferably ranges from 3.0 inches to 4.5 inches, and is most preferably 3.5 inches. The height, H, of the club head 42, as measured while in striking position, preferably ranges from 2.0 inches to 3.5 inches, and is most preferably 2.50 inches. The width, W, of the club head 42 from the toe section 68 to the heel section 66 preferably ranges from 4.0 inches to 5.0 inches, and more preferably 4.4 inches.

Figure 10:
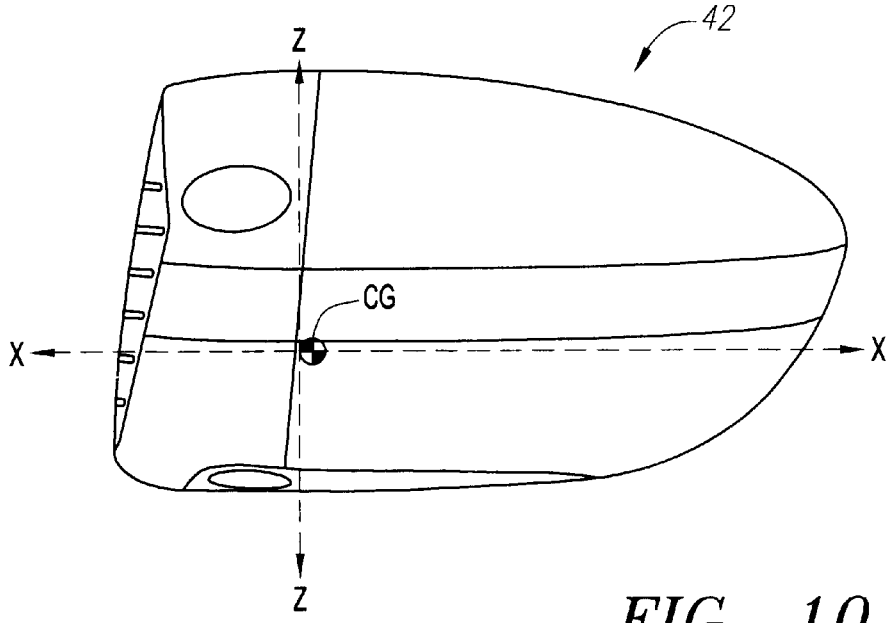
FIG. 10 is a heel side plan view of a golf club of the present invention illustrating the Z axis and X axis.
Figure 10A:
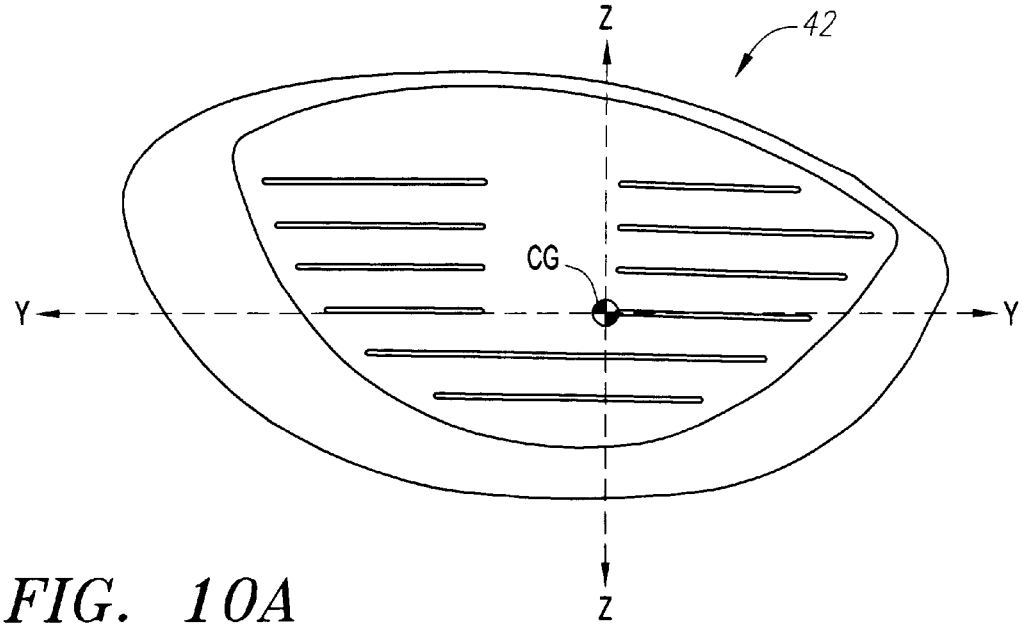
FIG. 10A is a front plan view of a golf club of the present invention illustrating the Z axis and Y axis.

FIGS. 10 and 10A illustrate the axes of inertia through the center of gravity of the golf club head. The axes of inertia are designated X, Y and Z. The X axis extends from the striking plate portion 72 through the center of gravity, CG, and to the rear of the golf club head 42. The Y axis extends from the toe section 68 of the golf club head 42 through the center of gravity, CG, and to the heel section 66 of the golf club head 42. The Z axis extends from the crown portion 62 through the center of gravity, CG, and to the sole portion 64.

As defined in *Golf Club Design, Fitting, Alteration & Repair,* 4$^{th}$ Edition, by Ralph Maltby, the center of gravity, or center of mass, of the golf club head is a point inside of the club head determined by the vertical intersection of two or more points where the club head balances when suspended. A more thorough explanation of this definition of the center of gravity is provided in *Golf Club Design, Fitting, Alteration & Repair.*

Figure 11:
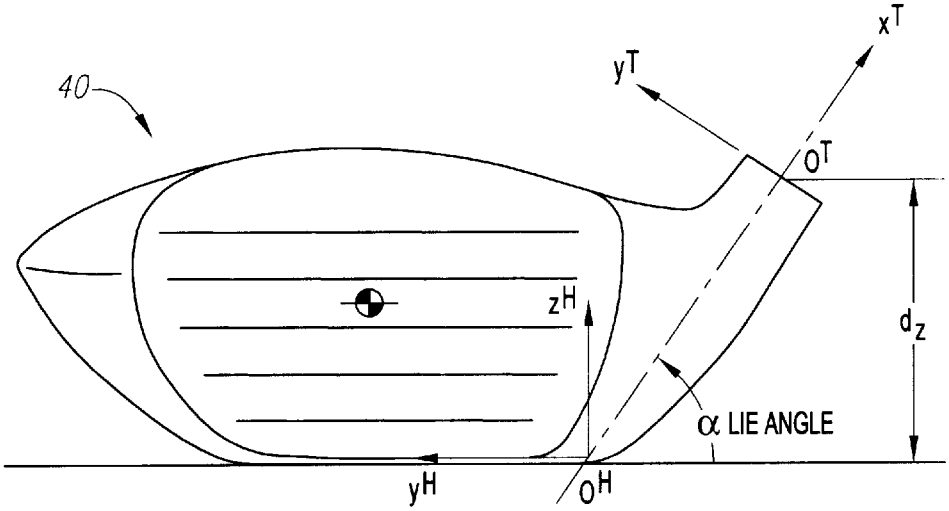
FIG. 11 is a front plan view of a golf club illustrating the test frame coordinates $X^T$ and $Y^T$ and transformed head frame coordinates $Y^H$ and $Z^H$.
Figure 11A:
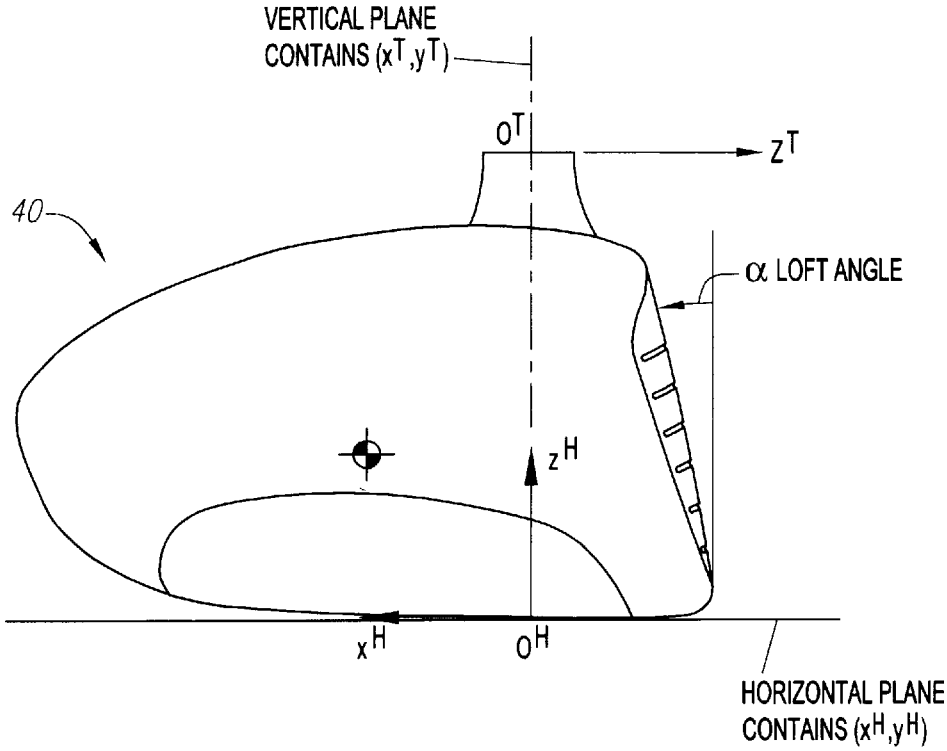
FIG. 11A is a toe end view of the golf club illustrating the test frame coordinate $Z^T$ and transformed head frame coordinates $X^H$ and $Z^H$.

The center of gravity and the moment of inertia of a golf club head 42 are preferably measured using a test frame ($X^T$, $Y^T$, $Z^T$), and then transformed to a head frame ($X^H$, $Y^H$, $Z^H$), as shown in FIGS. 11 and 11A. The center of gravity of a golf club head may be obtained using a center of gravity table having two weight scales thereon, as disclosed in co-pending U.S. patent application Ser. No. 09/796,951, filed on Feb. 27, 2001, entitled High Moment Of Inertia Composite Golf Club, and hereby incorporated by reference in its entirety. If a shaft is present, it is removed and replaced with a hosel cube that has a multitude of faces normal to the axes of the golf club head. Given the weight of the golf club head, the scales allow one to determine the weight distribution of the golf club head when the golf club head is placed on both scales simultaneously and weighed along a particular direction, the X, Y or Z direction.

TABLE One

| Head | Volume | Mass | Head Mass | Discreet Mass | COR | Material | Process |
|---|---|---|---|---|---|---|---|
| Ex. 1 | 430 cc | 270 g | 197 g | 73 g | 0.85 | Ti 6-4 | cast |
| Ex. 2 | 510 cc | 285 g | 200 g | 85 g | 0.896 | Ti 10-2-3 | Machnd |
| Ex. 3 | 385 cc | 285 g | 198 g | 84 g | 0.884 | Ti Alloy | Forged |

Table One lists the volume of the golf club heads 42, the overall weight, the weight of the head without weight members, the mass of the weight member 122, the coefficient of restitution (COR) on a scale from 0 to 1 using the USGA standard test, the material of the face component, and the process for manufacturing the face component 60. Example 1 is a 430 cubic centimeter golf club head 42 with the total club weighing 270 grams. The face component 60 is composed of a cast titanium, Ti 6-4 material. The aft body 61 is composed of a plurality of plies of pre-preg. The golf club head 42 has a loft angle of eleven degrees and a lie of 54 degrees. The bulge radius is 11 inches and the roll radius is 10 inches. The vertical distance h of the club head of example 1 is 2.14 inches, and the distance w is 3.46 inches. Example 2 is a 510 cubic centimeter golf club head 42 with the total golf club weighing 285 grams. The face component 60 is composed of a forged titanium alloy material, Ti 10-2-3. The aft body 61 is composed of a plurality of plies of pre-preg. The bulge radius is 11 inches and the roll radius is 10 inches. The vertical distance h of the club head of example 2 is 2.54 inches, and the distance w is 3.9 inches. Example 3 is a 385 cubic centimeter golf club head 42 with the total golf club weighing 198 grams. The face component 60 is composed of a forged titanium alloy material. The aft body 61 is composed of a plurality of plies of pre-preg. The golf club head 42 has a loft angle of eleven degrees and a lie of 54 degrees. The bulge radius is 11.5 inches and the roll radius is 10 inches. The vertical distance h of the club head of example 3 is 2.16 inches, and the distance w is 3.60 inches.

TABLE Two

| Head | Ixx | Iyy | Izz | Ixy | Ixa | Iyz |
|---|---|---|---|---|---|---|
| Ex. 1 | 2800 | 2545 | 4283 | 197 | 7 | 128 |
| Ex. 2 | 3232 | 2631 | 4263 | 230 | −116 | 246 |
| Ext. 3 | 2700 | 2200 | 3600 | 37 | 21 | 320 |

Table Two lists the moment of inertia for exemplary golf club heads 42 of Table One. The moment of inertia is given in grams-centimeter squared (g-cm$^2$). For example 1, the center of gravity is located at 0.901 inch in the X direction, 0.696 inch in the Y direction, and 1.043 inches in the Z direction. For example 3, the center of gravity is located at 0.654 inch in the X direction, 0.645 inch in the Y direction, and 1.307 inches in the Z direction.

In general, the moment of inertia, Izz, about the Z axis for the golf club head 42 of the present invention will range from 2800 g-cm$^2$ to 5000 g-cm$^2$, preferably from 3000 g-cm$^2$ to 4500 g-cm$^2$, and most preferably from 3750 g-cm$^2$ to 4250 g-cm$^2$ The moment of inertia, Iyy, about the Y axis for the golf club head 42 of the present invention will range from 1500 g-cm$^2$ to 2750 g-cm$^2$, preferably from 2000 g-cm$^2$ to 2400 g-cm$^2$, and most preferably from 2100 g-cm$^2$ to 2300 g-cm$^2$.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

What is claimed is:

1. A golf club head comprising:

a face component composed of a titanium alloy material, the face component having striking plate portion and a return portion, the striking plate portion having a thickness in the range of 0.010 inch to 0.250 inch and the return portion having a thickness ranging from 0.010 inch to 0.250 inch, the return portion extending a distance ranging 0.25 inch to 1.5 inches from a perimeter of the striking plate portion; and an aft-body composed of a composite material, the aft body having a crown portion, a sole portion and a ribbon portion, the aft-body attached to the return portion of the face component;

wherein the golf club head has a coefficient of restitution of 0.80 to 0.94.

2. The golf club head according to claim 1 wherein the striking plate portion has a thickness in the range of 0.055 inch to 0.125 inch.

3. The golf club head according to claim 1 wherein the striking plate portion has a thickness in the range of 0.060 inch to 0.111 inch.

4. The golf club head according to claim 1 wherein the aft-body is composed of a plurality of plies of pre-preg material.

5. The golf club head according to claim 1 wherein the striking plate portion has an aspect ratio no greater than 1.7.

6. The golf club head according to claim 1 wherein the striking plate portion has concentric regions of varying thickness with the thickest region in about the center.

7. The golf club head according to claim 1 wherein the striking plate portion comprises a central elliptical region having a base thickness, a first concentric region having a first thickness wherein the base thickness is greater than the first thickness, a second concentric region having a second thickness wherein the first thickness is greater than the second thickness, a third concentric region having a third thickness wherein the second thickness is greater than the third thickness, and a periphery region having a fourth thickness wherein the fourth thickness is less than the third thickness.

8. The golf club head according to claim 1 wherein the return portion has a thickness ranging from 0.025 inch to 0.150 inch.

9. The golf club head according to claim 1 wherein the golf club head has a volume ranging from 290 cubic centimeters to 600 cubic centimeters.

10. The golf club head according to claim 1 wherein the moment of inertia about the Izz axis of the golf club head is greater than 3000 grams-centimeter squared.

11. A golf club head comprising:

a face component composed of a titanium alloy material, the face component having striking plate portion and a return portion, the striking plate portion having a thickness in the range of 0.010 inch to 0.250 inch and the return portion having a thickness ranging from 0.010 inch to 0.250 inch, the return portion extending a distance ranging 0.25 inch to 1.5 inches from a perimeter of the striking plate portion; and an aft-body composed of a plurality of plies of pre-preg, the aft body having a crown portion, a sole portion and a ribbon portion, the aft-body attached to the return portion of the face component, the aft body having a thickness ranging from 0.015 inch to 0.100 inch;

a weighting member disposed within the ribbon of the aft-body, the weighting member having a mass ranging from 10 grams to 100 grams;

wherein the moment of inertia about the Izz axis through the center of gravity is greater than 3000 grains-centimeter squared, and the moment of inertia about the Iyy axis through the center of gravity is greater than 1900 grams-centimeter squared.

12. A golf club head comprising:

a face component composed of a metal material and comprising a return portion and a striking plate portion, the striking plate portion having an exterior surface and an interior surface, the striking plate portion extending from a heel section of the golf club head to a toe section of the golf club head, a return extending laterally inward from a perimeter of the striking plate portion, the return portion having a first face weight member at an upper section and a second weight member at a lower section, and an interior tubing for receiving a shaft, the interior tubing engaging the upper section of the return portion and the lower section of the return portion; and an aft body composed of a plurality of plies of pre-preg, the aft body comprising crown portion, a ribbon portion and a sole portion, the crown portion bonded to the upper section of the return portion and the upper section of the return portion overlapping the crown portion a distance of at least 0.25 inch, the sole portion bonded to the lower section of the return portion and the lower section of the return portion overlapping the sole portion a distance of at least 0.25 inch.

13. A golf club head comprising:

a face component composed of a titanium alloy material, the face component having striking plate portion and a return portion, the striking plate portion having a thickness in the range of 0.010 inch to 0.250 inch and the return portion having a thickness ranging from 0.020 inch to 0.250 inch, the return portion extending a distance ranging 0.25 inch to 1.5 inches from a perimeter of the striking plate portion, the return portion having a first face weight member at an upper section and a second weight member at a lower section; and an aft-body composed of a plurality of plies of pre-preg, the aft body having a crown portion and a sole portion, the aft-body attached to the return portion of the face component; and a weighting member disposed within the ribbon of the aft-body, the weighting member having a mass ranging from 30 grams to 100 grams;

wherein the moment of inertia about the Izz axis through the center of gravity of the golf club head is greater than 3000 grams-centimeter squared, and the moment of inertia about the Iyy axis through the center of gravity of the golf club head is greater than 1900 grams-centimeter squared.

14. A golf club bead comprising:

a face component composed of a titanium alloy material, the face component having striking plate portion and a return portion, the striking plate portion having a thickness in the range of 0.010 inch to 0.250 inch, the return portion extending a distance ranging 0.25 inch to 15 inches from a perimeter of the striking plate portion, the return portion having a first face weight member at an upper section and a second weight member at a lower section; and an aft-body composed of a plurality of plies of pre-preg, the aft body having a crown portion and a sole portion, the aft-body attached to the return portion of the face component;

wherein the golf club head has a volume ranging from 350 cubic centimeters to 525 cubic centimeters and a mass ranging from 175 grams to 225 grams.

15. A golf club head comprising:

a face component composed of a forged titanium alloy material and comprising a return portion and a striking plate portion, the striking plate portion having concentric regions of varying thickness with the thickest region about the center of the striking plate portion, the striking plate portion extending from a heel section of the golf club head to a toe section of the golf club head and having an aspect ratio no greater than 1.7, the return portion extending laterally inward at least 0.50 inch from a perimeter of the striking plate portion, the return portion extending laterally inward 360 degrees of the perimeter of the striking plate portion, and an interior tubing for receiving a shaft, the interior tubing engaging an upper section of the return portion and a lower section of the return portion; and an aft body composed of a plurality of plies of pre-preg and having a thickness ranging from 0.010 inch to 0.100 inch, the aft body comprising crown portion, a ribbon portion, a sole portion and an inward recessed portion, the return portion overlapping the inward recessed portion and attached to the inward recessed portion with an adhesive, the crown portion, the sole portion, the ribbon portion and the return portion defining a gap, the gap also defined by an exterior surface of the inward recessed portion, the gap having a distance from an edge of the return portion to an exposed edge of the aft-body ranging from 0.02 inch to 0.09 inch.

16. The golf club head according to claim 15 wherein the return portion overlaps the inward recessed portion a distance ranging from 0.05 inch to 0.75 inch.

17. The golf club head according to claim 15 wherein the aft-body further comprises an interior projection extending from the inward recess portion to the interior surface of the return portion, the interior projection extending from 0.005 inch to 0.035 inch to define a bond thickness for the adhesive.

18. A golf club head comprising:

a face component composed of a titanium alloy material, the face component having striking plate portion and a return portion, the striking plate portion having a central elliptical region having a base thickness less than 0.120 inch, a first concentric region having a first thickness wherein the base thickness is greater than the first thickness, a second concentric region having a second thickness wherein the first thickness is greater than the second thickness, a third concentric region having a third thickness wherein the second thickness is greater than the third thickness, and a periphery region having a fourth thickness wherein the fourth thickness is less than the third thickness, the return portion extending a distance ranging 0.25 inch to 1.5 inches from a perimeter of the striking plate portion, the return portion having a first face weight member at an upper section and a second weight member at a lower section; and an aft-body composed of a plurality of plies of pre-preg, the aft body having a crown portion and a sole portion, the aft-body attached to the return portion of the face component;

wherein the golf club bead has a volume ranging from 330 cubic centimeters to 500 cubic centimeters.

* * * * *